United States Patent [19]

Larson

[11] Patent Number: 4,472,786

[45] Date of Patent: Sep. 18, 1984

[54] ANALOG GAUSSIAN CONVOLVER

[75] Inventor: Noble G. Larson, Arlington, Mass.

[73] Assignee: The United States of America as represented by the Secretary of the Navy, Washington, D.C.

[21] Appl. No.: 371,356

[22] Filed: Apr. 23, 1982

[51] Int. Cl.[3] ..... G06G 7/19

[52] U.S. Cl. ..... 364/822; 364/820; 364/824

[58] Field of Search ..... 364/728, 819, 820, 821, 364/822, 823, 824; 324/77 G, 77 H, 77 K, 77 J; 343/384

[56] References Cited

U.S. PATENT DOCUMENTS 4,347,580 8/1982 Bond ..... 364/824

*Primary Examiner*—Jerry Smith
*Assistant Examiner*—Allen MacDonald
*Attorney, Agent, or Firm*—Robert F. Beers; Arthur A. McGill; Prithvi C. Lall

[57] ABSTRACT

An analog Gaussian convolver for performing high speed convolutions of arbitrary functions (e.g. image arrays) with masks or operators which uses two units of 2-dimensional Gaussians G(u,v) and the like. The output of the two units are subtracted to obtain difference of Gaussian operators (DOG), a very important parameter in computer vision. Input data in the form of a 2-dimensional digital array representing image pixels from the image array is converted into analog form and is then convolved with a 1-dimensional Gaussian operator in a first direction and the result is clocked into a tapped analog delay line. The outputs of the analog tapped delay line are also convolved with another (normally identical) 1-dimensional Gaussian operator in a direction normal to the first direction. The results so obtained represents the convolution of the image with a 2-dimensional Gaussian operator in a channel. By duplicating the two 1-dimensional convolvers and driving a second channel with the same rastering window, the image can be simultaneously convolved with another Gaussian operator and obtaining convolution with a DOG which is useful in a computer vision system for edge detection and binocular stereo.

7 Claims, 2 Drawing Figures

ANALOG GAUSSIAN CONVOLVER

BACKGROUND OF THE INVENTION

This application is related to a co-pending application; Ser. No. 371,355 filed Apr. 23, 1982; entitled Digital Gaussian Convolver wherein the sole inventor in subject patent application is one of the co-inventors and the assignee of both patent applications is the same.

This invention is related to vision systems and, more particularly, to an image analysis using edge detection which is accomplished by means of an analog convolver.

As pointed out by Hildreth in the September/October 1981 issue of Robotics Age which is herein incorporated by reference, most vision systems begin by finding edges. This is true of a human vision system and can be the case for a machine made vision system. In the case of human vision system, it first registers light intensity with the array of photo receptors in the retina and the image is sensed at a high resolution. As an example, one square inch, viewed from a distance of 3 feet, covers an array of about 200×200 to 40,000 photo receptors. Several layers of cells in the retina process the detected light intensity. It has been found that light striking the center of the cell's receptive field excites the activity of the cell while light striking the surrounding area inhibits it. The variation of the sensitivity of cells a vision system has been studied and the shape of sensitivity distribution has been described mathematically as the difference of two concentric Gaussian distributions given by:

$$G_1(x,y) - G_2(x,y) = \frac{1}{2\pi s_1^2}\left[\exp\left(-\frac{r^2}{2s_1^2}\right)\right] - \frac{1}{2\pi s_2^2}\left[\exp\left(-\frac{r^2}{2s_2^2}\right)\right]$$

where r is the radius from the center and $s_1$ and $s_2$ are the spatial scale factors of the excitatory and inhibitory distributions, respectively. It is the shape of this distribution which is considered significant rather than its magnitude. It has been suggested that the processing of the information done in the retina is non-oriented with the simple cells processing the results to find edges, i.e. significant intensity changes in an image.

The above-mentioned ideas have been put forward by Marr and Poggio in their M.I.T. Artificial Intelligence Laboratory Memo 451; (November 1977) Marr and Hildreth in their M.I.T. Artificial Intelligence Laboratory Memo 518 (1979) and by W. E. L. Grimson in M.I.T. Artificial Intelligence Laboratory Memo 565 (January 1980) which are herein incorporated by reference. These ideas have been used in image processing and computer vision in conjunction with the mathematical process of convolution using a Gaussian function.

One approach to edge detection proceeds in two steps: First the image is smoothed (low pass filtered) by convolving it with a 2-dimensional Gaussian operator. The purpose of this is to control the scale at which subsequent processes, such as stereo matching, are performed. The filtered image can be represented mathematically by:

$$I_{out}(x,y) = I_{in}(x,y) * G(x,y)$$

The next step is to detect edge-related features in the filtered image. This can be accomplished by differentiating it, using a 2-dimensional Laplacian Operator, and finding the zero-crossings in the resulting function.

It can be shown, mathematically, that the Laplacian operator applied to a Gaussian operator can be approximated by a difference of Gaussians, similar to the mechanism described above, in reference to the human vision system.

It is thus desirable to have a device which performs the above mentioned two steps to process image by using computer vision involving edge detection.

SUMMARY OF THE INVENTION

The input to the convolver is a vertical column or window, one pixel (a unit of information in the image) wide and with height equal to the height of the operator. This window scans the image array in a (non-interlaced) raster fashion. The information in the window is represented in digital form. Separability of the Gaussian allow breaking the 2-dimensional convolution into two pipe-lined 1-dimensional convolutions. The symmetry of the Gaussian operator allows compressing of the window into half the height of the operator by adding pixels in mirror image pairs. The values of the compressed raster window are converted into analog form using a plurality of digital-to-analog converters (DAC) and are convolved with a 1-dimensional Gaussian operator. The result is clocked into a tapped analog delay line. On each clock tick, various analog outputs of the tapped analog delay line are also convolved with another (normally identical) 1-dimensional Gaussian operator. Symmetry need not be invoked here since the convolution is fairly easy to effect as all the signals involved are in analog form. The output of this stage represents the convolution of the image with a 2-dimensional Gaussian operator. This may be a very useful result in itself. By duplicating the two 1-dimensional convolvers and driving the second channel with the same raster window, the image can be simultaneously convolved with another (different) Gaussian operator. Substracting the outputs of the two channels, results in convolution with a difference of Gaussians (DOG).

An object of the subject invention is to convolve image arrays with 2-dimensional Gaussian operator using analog hardware.

Another object of the subject invention is to convolve image arrays with 2-dimensional difference of Gaussian operator.

Still another object of the subject invention is to process an image using edge detection techniques.

Other objects, advantages and novel features of the invention will become apparent from the following detailed description of the invention when considered in conjunction with the accompanying drawing wherein:

DESCRIPTION OF A PREFERRED EMBODIMENT

A simplified explanation of the mathematical process of convolution which is very important in image processing and computer vision will now be discussed using an example in two dimensions. It involves integrating the product of two functions, I(x,y) and M(x,y), over some region, R. Frequently these two functions correspond to an image and a mask, respectively. Convolving I(x,y) with M(x,y), the latter being offset so as to be centered at point (u,v) in the image, produces a convolved image, I*M(u,v) which is given by:

$$I*M(u,v) = \int \int_R I(x,y)M(u-x,v-y)dydx$$

In general, approximately this on a computer involves multiplying the values of I and M together throughout the region, and then adding all of the products together. As an example, if the region is a 32×32 square, it requires 1024 multiplications and 1024 additions, for each point in the convolved image. Since images are typically represented by 512×512 or 1024×1024 arrays this results in as many as a billion multiplications and additions. Such a computation can take many hours on even a large computer.

For most mask functions, M, this can not be avoided. Fairly recently, however, a theory of computer vision has been proposed by Marr and Poggio, as mentioned earlier in the background of the invention, which relies almost totally on Gaussian masks, i.e. masks of the form: $M(x,y)=\exp(-x^2-y^2)$. A special nature of the Gaussian functions has been noted in the past in that a Gaussian is the only rotationally symmetric function which can be factored into a product of a function of x and a function of y; i.e. $G(x,y)=\exp(-x^2-y^2)=\exp(-x^2)\exp(-y^2)$. This has great significance for the evaluation of convolution integrals. In particular it allows the integral I*G(u,v) to be separated and expressed as:

$$I*G(u,v) = \int \exp-(u-x)^2[\int I(x,y)\exp-(v-y)^2dy]dx$$

This means that for a 32×32 region, the convolution at point (u,v) can be computed by convolving each column of the region with a one dimensional mask: $\exp(-y^2)$, and then convolving the 32 results with the same mask in the x-direction. At first, it might seem that nothing has been gained, since it would appear that still 1024 multiplications and additions have been performed. However, if the mask is shifted over to the right by one unit, to compute the convolution for the next point; (u+1,v), all the column convolutions except one will be used again. Consequently, all one has to do is to perform the vertical convolution on the new column of data on the right and run the horizontal convolution on the 31 old results plus the one new result. Hence for each point we are doing 64 multiplications and additions rather than 1024. This type of algorithm has been successfully used to perform efficient Gaussian convolutions in software.

Figure 1:
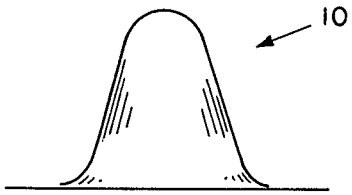
FIG. 1 is a schematic representation of a 2-dimensional Gaussian function.

FIG. 1 schematically shows a 2-dimensional Gaussion function. It can be compared to a symmetrical hill in three dimensions. Cross sections of the 2-dimensional Gaussian function as shown in FIG. 1 represent 1-dimensional Gaussian functions of varying peaks. It should be pointed out that the word "pixel" used throughout subject application means a unit of information in the digital 2-dimensional array.

Figure 2:
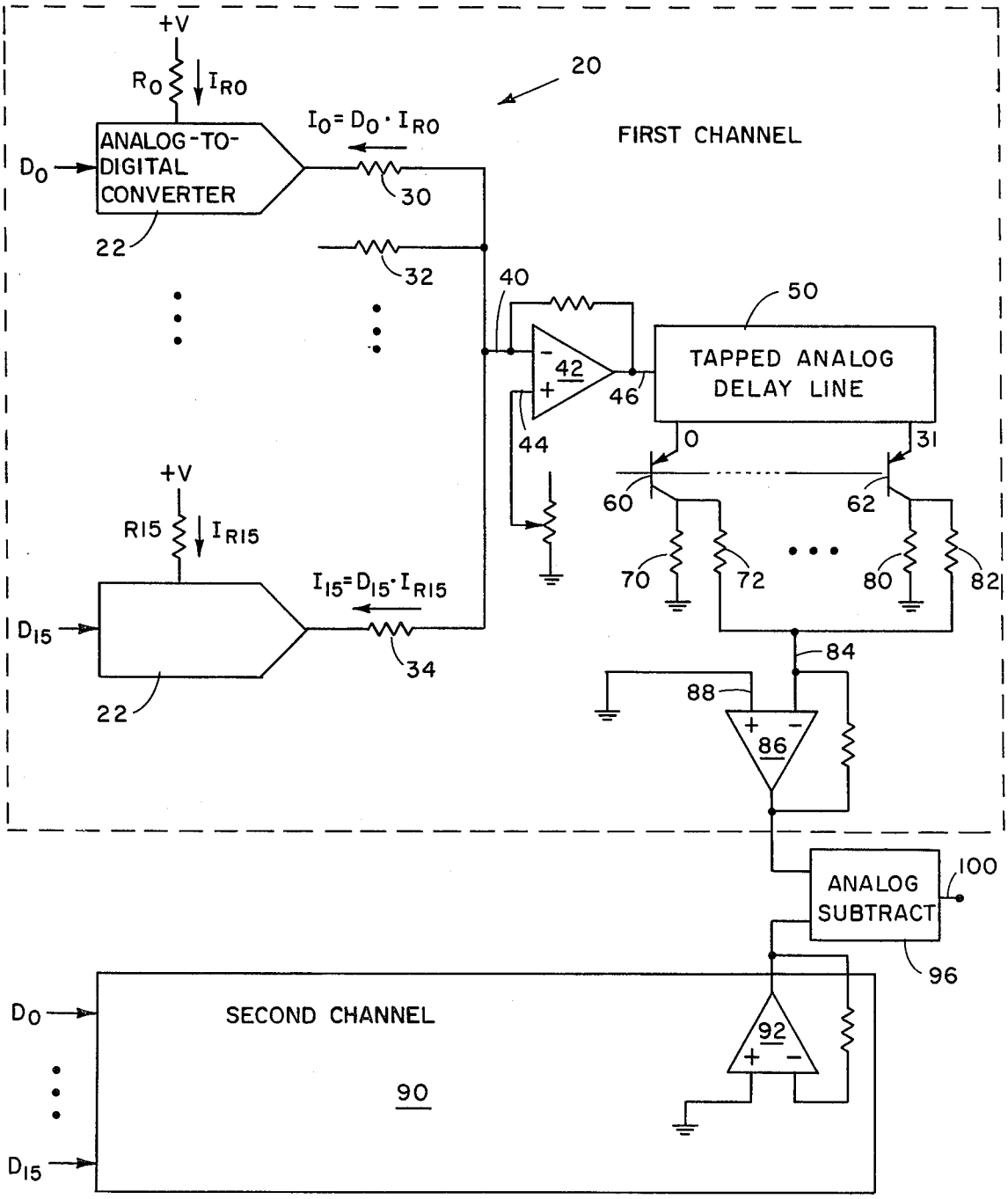
FIG. 2 is a block diagram of an analog convolver according to the teachings of the subject invention.

FIG. 2 is a block diagram of the circuit of analog Gaussian convolver 20 built according to the teachings of subject invention. The convolver of subject invention is capable of performing high speed convolutions of arbitrary functions with masks that are either Gaussians or differences of Gaussians (DOGS). The masks extend over a 32×32 point region. It is to be noted that the extension of the masks over a 32×32 point region is only as an example not as a limitation. Due to the separability and symmetry of the Gaussian as described above, such masks or operators can be represented by 16 numbers which constitute ½ of a 1-dimensional region through the center with truncation occurring after the values become close to zero. A vertical slit shaped window scans the digital image array in a TV raster fashion (non-interlaced). This window constitutes the input to the digital convolver. The height of the window is 32 pixels. The resulting 16 digital values are fed into 16 multiplying-current digital-to-analog converters (hereinafter referred to as MDAC) such as elements 22. By a way of illustrations and not as a limitation, MDAC can be signetics NE 5008 or their equivalent. Each MDAC is provided with a fixed current which is proportional to the value of the desired 1-dimensional Gaussian function at a particular position. This is accomplished by using a plurality of resistors such as $R_0, \ldots R_{15}$ and another set of resistors such as 30, 32, and 34 etc. as shown in FIG. 2. The MDAC receiving pixels #15 and #16 has a reference current proportional to the central maximum of the first 1-dimensional Gaussian function. The MDAC receiving pixels #0 and #31 has a reference current proportional to the value of the first 1-dimensional Gaussian function at the farthest point from the center, i.e. very close to zero. The MDAC output current is therefore the product of the reference current (i.e. operator value) and the digital input (sum of the two image pixels). The output currents 40 of the 16 MDAC's are summed in a standard op-amp summing circuit 42. The output of this is a voltage level equal to the 1-dimensional convolution of the raster window, with the particular Gaussian represented by the reference currents of the MDAC's. This voltage is fed into a 32 element, tapped analog delay line 50. At any point in time (excluding boundry effects) this delay line contains information reflecting the convolution of each column in a 32×32 pixel patch of the input image array, with the 1-dimensional Gaussian. These 32 voltages are then converted into currents through transistors such as 60 and 62 and given a multipicative weight by means of resistive current dividers such as those using either resistors 70 and 72 or resistors 80 and 82. The result of these 32 currents, each equal to the value of the vertical convolution multiplied by a fixed weighting factor. Currents 84 can easily be summed by means of another op-amp summing circuit 86, similar to the one used in the vertical stage. By making the weighting factors proportinal to the same 1-dimensional Gaussian used in the vertical stage, the output of the second op-amp is equal to the convolution of the input image with a 2-dimensional Gaussian operator. This analog signal can be fed to an analog to digital converter, or fed to a comparator for detection of zero crossings. The output of an identical channel 90 when subtracted in circuit 96 from the output of operational amplifier 86 gives an output 100 which represented the convolved image array using difference of Gaussian.

Briefly stated, the input to the device is a 2-dimensional digital array which is convolved using analog hardware and difference of two Gaussians and the convolved image array is then used for identifying zero-crossings.

Obviously, many modifications and variations of the subject invention are possible in the light of the above teachings. As an example, all the hardware components can be substituted by their equivalents. Different Gaussian functions or other symmetric and separable in 2-dimensional functions can be used as operators. It is, therefore, to be understood that within the scope of the appended claims, the invention may be practiced otherwise than as specifically described.

What is claimed is:

1. An analog convolver for processing an image in the form of a digital 2-dimensional array representing image pixels using a computer vision system which comprises:

first means for converting digital imput information from the digital 2-dimensional image array into an analog form;

means for convolving in a first direction the input information from the 2-dimensional image array in the analog form using a first 1-dimensional symmetric function and for producing an output current thereof;

second means for converting the output current of said means for convolving to a corresponding voltage output;

means for simultaneous storing and convolving, using the first 1-dimenstional function, the output of said second means for converting the output current of said means for convolving in a direction normal to said first direction and producing an output representing convolution of said image array using a first 2-dimensional symmetric function;

means for producing an output representing convolution of said image array using a second 2-dimensional symmetric function; and means for subtracting the output representing convolution of said image array using said first 2-dimensional symmetric function and the output representing convolved image array using said second 2-dimensional symmetric function and obtaining a convolved image array using the difference of the first and the second two 2-dimensional symmetric functions.

2. The analog convolver of claim 1 wherein said first 1-dimensional symmetric function and said second 1-dimensional symmetric function are of generally identical mathematical configuration.

3. The analog convolver of claim 1 wherein said first 1-dimensional symmetric function and said second 1-dimensional symmetric function are cross sections of a 2-dimensional Gaussian function.

4. The analog convolver of claim 3 wherein said means for converting digital input information from the 2-dimensional image array into an analog form includes a plurality of digital-to-analog converters.

5. The analog convolver of claim 4 wherein said means for convolving in a first direction the input information from the 2-dimensional image array in the analog form includes means for providing a plurality of reference currents representing various values of the first 1-dimensional symmetric Gaussian function.

6. The analog convolver of claim 5 wherein said means for simultaneous storing and convolving includes a tapped analog delay line for sequentially storing the output of said third means.

7. An analog convolver of claim 6 wherein said means for simultaneous storing and convolving further includes a plurality of voltage dividers for generating values to convolve the image array in a direction normal to the first direction.

* * * * *